US005287570A

United States Patent [19]

Peterson et al.

[11] Patent Number: 5,287,570

[45] Date of Patent: Feb. 22, 1994

[54] CONTROL SYSTEM FOR WATER FAUCETS

[76] Inventors: Donald A. Peterson, 13204 Myford Rd., Tustin, Calif. 92680; Bryan J. Broussard, 1139 Charleston St., Costa Mesa, Calif. 92626

[21] Appl. No.: 841,537

[22] Filed: Feb. 26, 1992

[51] Int. Cl.[5] ..... E03C 1/00

[52] U.S. Cl. ..... 4/626; 4/625; 4/668

[58] Field of Search ..... 4/598, 623, 625, 665, 4/668, 676, 677; 236/12.1, 12.12

[56] References Cited

U.S. PATENT DOCUMENTS

| | | | |
|---|---|---|---|
| 3,370,609 | 2/1968 | Botnick | 137/607 |
| 3,374,957 | 3/1968 | Tyler | 4/269 X |
| 3,450,159 | 6/1969 | Wilkin | 4/676 X |
| 3,556,146 | 1/1971 | Groen | 4/623 |
| 3,576,277 | 4/1971 | Blackman | 4/623 |
| 3,594,825 | 7/1971 | Reid | 4/664 |
| 3,638,680 | 2/1972 | Kopp | 4/677 X |
| 3,750,196 | 8/1973 | Halferty | 4/625 |
| 4,162,218 | 7/1979 | McCormick | 4/663 X |
| 4,189,792 | 2/1980 | Veach | 4/677 |
| 4,563,780 | 1/1986 | Pollack | 4/668 |
| 4,735,357 | 4/1988 | Gregory et al. | 4/623 X |
| 4,756,030 | 7/1988 | Juliver | 4/668 |
| 4,854,499 | 8/1989 | Neuman | 4/605 X |
| 4,923,116 | 5/1990 | Homan | 4/668 X |
| 4,941,608 | 7/1990 | Shimizu et al. | 4/668 X |
| 5,165,456 | 11/1992 | Woolman | 4/625 X |

FOREIGN PATENT DOCUMENTS

| | | | |
|---|---|---|---|
| 0160041 | 12/1979 | Japan | 4/665 |

*Primary Examiner*—William A. Cuchlinski, Jr.
*Assistant Examiner*—W. Morris Worth
*Attorney, Agent, or Firm*—Willie Krawitz

[57] ABSTRACT

A control system for water faucets comprises an on-off control switch located at a sink and actuated by pressure applied and released by the body of the user. When the body of the user pushes forward towards the sink, the switch will be depressed and the water faucets will turn on. When the user backs away from the sink, the switch will be released and close off the flow of water. An overflow reservoir is provided to collect cold water run off prior to the time when hot water makes its way through the water pipes, and a temperature sensor switch and/or alarm controls either an automatic or manual change over from hot to cold water. In addition, a microprocessor and key board control various water delivery functions such as volume and temperature. The control system reduces leakage and saves water which would otherwise be lost due to running the hot water until it becomes heated to the desired temperature.

3 Claims, 3 Drawing Sheets

CONTROL SYSTEM FOR WATER FAUCETS

BACKGROUND OF THE INVENTION

This invention relates to a new and improved system for controlling water delivery to a kitchen sink, and the like, and more specifically for a system which controls the on-off function of a water faucet, excess water use, temperature, volume, and so forth, while reducing both leaks, and the use of hand controls.

Various water flow control and flow monitoring systems have been developed in the past, and typical prior art publications are disclosed in U.S. Pat. Nos. 3,370,609; 3,374,957; 3,450,159; 3,556,146; 3,576,277; 3,638,680; 4,189,792; and, 4,735,357.

Some of these prior art patents describe control systems which use infra red light to actuate an on-off control mechanism for a water supply; other systems use photoelectric s cells to detect the presence of a user's hands to control the on-off mechanism; and, still other patents describe the use of electromagnetic energy, which may include a proximity detector to control the on-off mechanism of the water supply.

However, none of these prior art systems describe the capability of saving cold water which has been passed through the pipe lines of a system prior to the onset of hot water flow, and this cold water is invariably lost. Also, none of these systems provide an effective way of controlling an on-off switch which eliminates the use of a detection system but which still depends on the presence of a user in the immediate vicinity of a sink where control of the water takes place.

THE INVENTION

According to the invention, there is provided a control switch which automatically turns on due to body pressure of the user when being in the immediate vicinity of the control switch, and when the user stands away from the sink, and hence the switch, the release of body pressure will turn off the switch. Thus, control of the on-off switch is dependent on the user being in the immediate vicinity of the sink, and not on a remote control device.

In addition, the control system is designed to provide a reservoir for collecting cold water which is present in the water pipe lines and which usually must be first flushed out prior to the onset of hot water flow.

Also, the control system of the invention is provided with a microprocessor control which controls not only the precise volume of water desired by the user, but also sets the desired temperature. This enables the user to control only that amount of water specifically desired, and thereby to reduce unnecessary water consumption.

DESCRIPTION OF THE PREFERRED EMBODIMENTS

Figure 1:
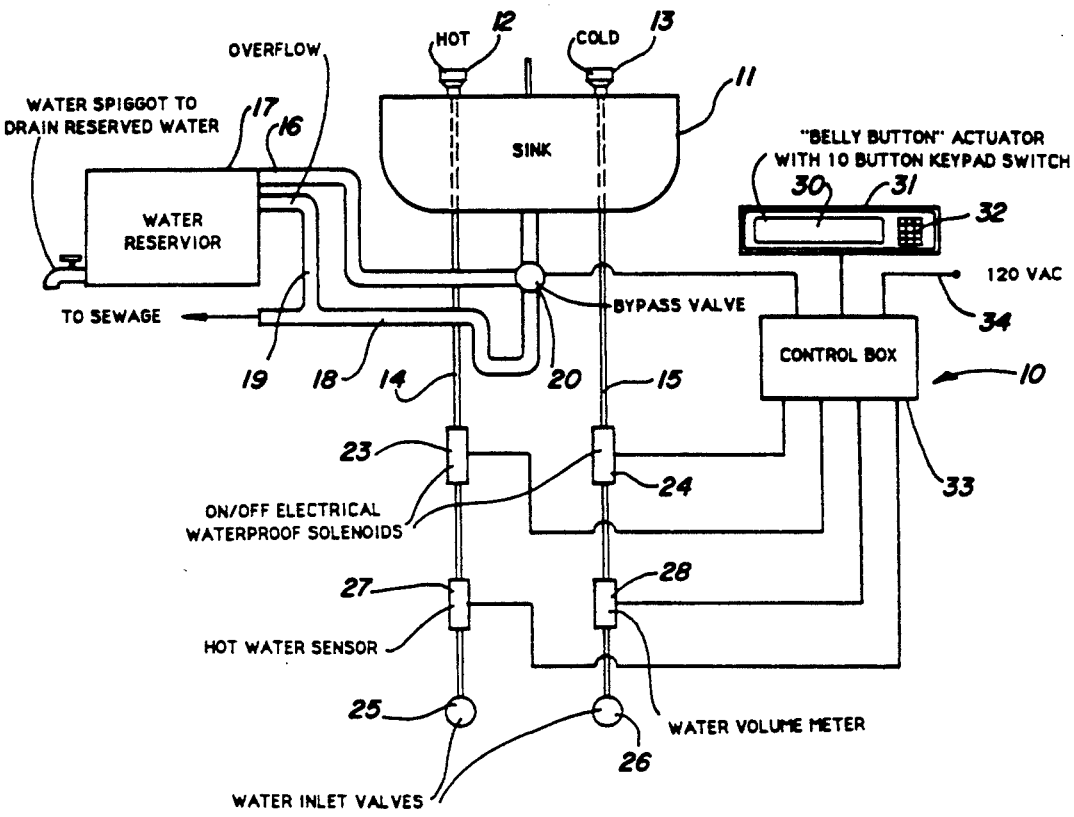
FIG. 1 is a schematic representation of the control system of this invention; and, FIGS. 2–5 are flow diagrams for different operating modes of the control system.
Figure 1:
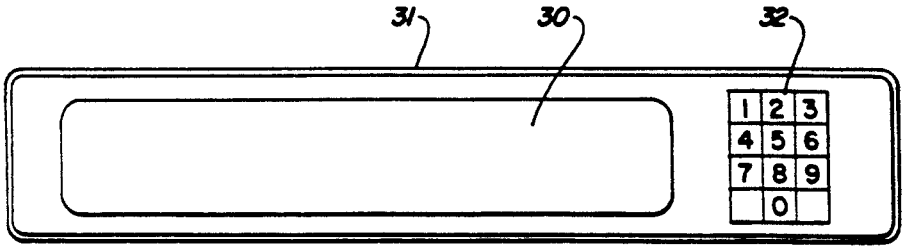

The control system 10 of this invention is shown in FIG. 1, and comprises a typical kitchen sink 11 having hot and cold water faucets 12 and 13, and corresponding hot and cold water feed lines 14 and 15. A first drain pipe 16 leads to a removable water reservoir 17 of suitable capacity, say five gallons, and a second drain pipe

18 leads to sewage. An overflow drain pipe 19 leads from the water reservoir 17 and connects to the second drain pipe 18 and sewage. A by-pass valve 20 controls the diversion of water from the sink to the reservoir 17 or to sewage.

Waterproof, on-off solenoid switches 23 and 24 are mounted within the hot and cold water feed lines 14 and 15, and water inlet valves 25 and 26 control the hot and cold water on-off functions, and are actuable by the solenoids.

A hot water sensor 27 is mounted in the hot water feed line 14 to monitor the hot water temperature, and a water volume meter 28 is mounted on the cold water feed line 15.

An on-off control switch 30 is mounted on or closely adjacent to the sink 11, and when pressed, will turn on the water flow if the faucets 12 and 13 are in the 'on' position. Thus, the control switch and faucets perform an 'and' function which means both must be in the 'on' position in order for the system to operate.

When a person is in close proximity to the sink, pressure of their body against the switch 30 will turn it on; this will actuate the solenoids switches 23, 24 and water inlet valves 25, 26 and turn on the water. However, when a person moves away from the sink, their body pressure against the switch is removed, causing it to turn off; this actuates the solenoids and water inlet valves to turn off the water.

The switch 30 is mounted on a panel 31 along with a built-in microprocessor (not shown) which programs various operations into the system 10, the microprocessor being connected to a function pad 32 from which the input programs are initiated. The switch and microprocessor are connected to a control box 33 which powers the various components of the system, using a standard 120 VAC power input 34.

Figure 2:
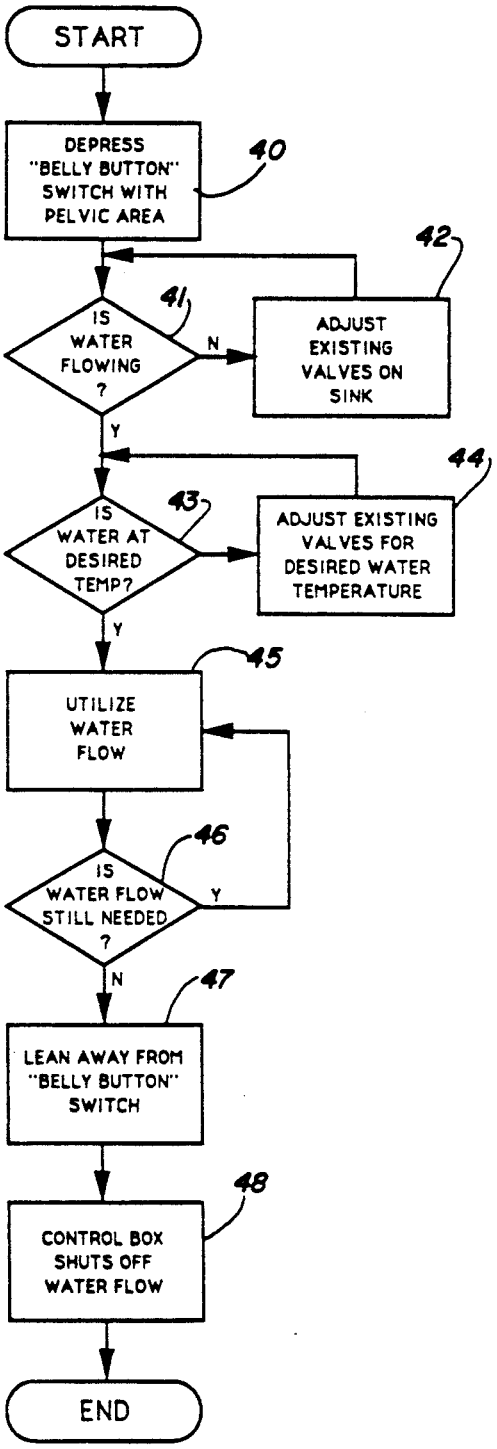

The flow diagrams of FIGS. 2–5 show various operating modes of the control system 10, the flow chart symbols being numerically designated. FIG. 2 shows a program for initiating water flow at a specific water temperature. Water flow is initiated 40 by depressing the switch 30 with the user's body, and if no water flows 41, the program loops until the user manually opens 42 the faucets to commence water flow. The user will then manually adjust the sink knobs 12 and 13 until the desired water temperature is reached. When the desired temperature is reached 43, 44 the user can utilize the water 45 as long as the user continues to lean on switch 30. If the user then leans away 47 from the control switch 31, the microprocessor will turn off the water supply 48, and the program terminates.

Figure 3:
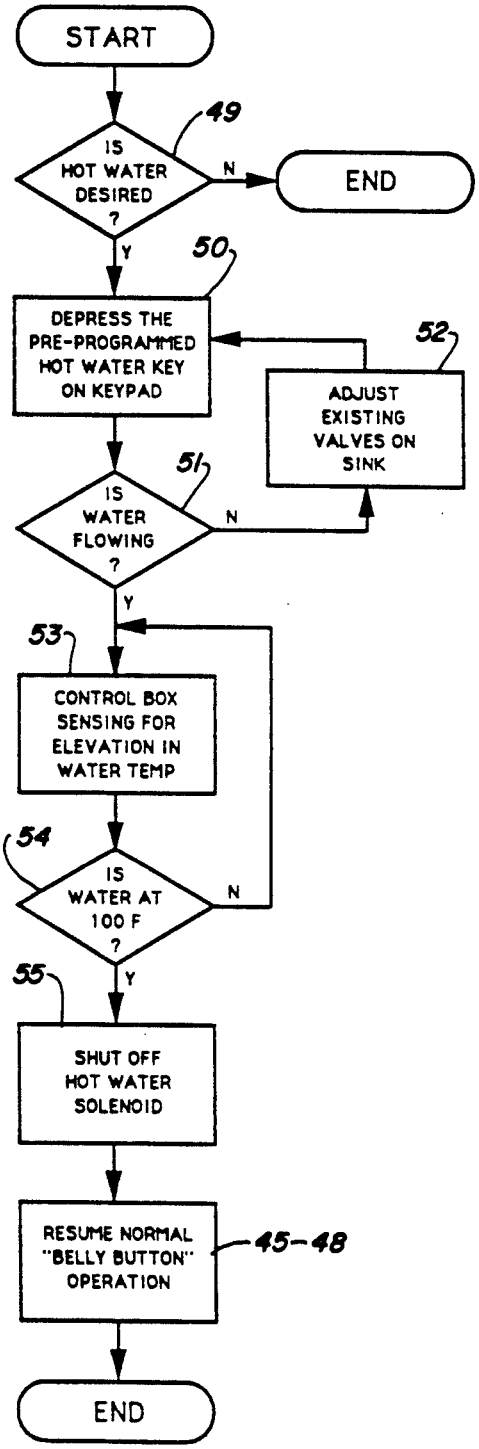

FIG. 3 is a flow chart for the control of hot water, commencing with the user indicating 49 if hot water is desired. The program key on the function pad 32 is depressed 50, and if no water flows 51, the hot and cold water faucets 12 and 13 are manually opened by the user 52. The hot water sensor 27 senses the water temperature 53, and compares it 54 with the set water temperature of say, 100 F. If the temperature is below the set temperature of 100 F., the programs continues looping until the set temperature is arrived at, and the solenoids 23 and 24 will then turn off the hot water 55. The program then continues along normal water utilization operations 45–48 shown in FIG. 2.

Figure 4:
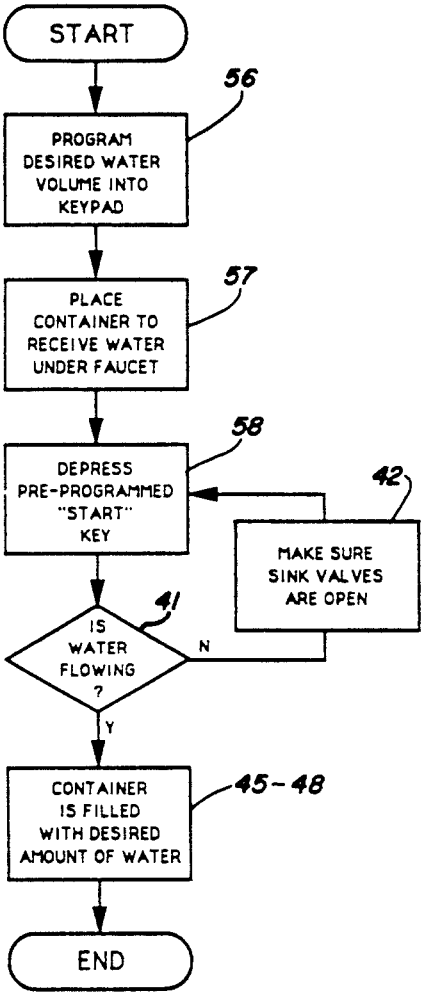

FIG. 4 shows the program for obtaining a desired volume of water in the sink. Initially, a fixed amount of water is entered 56 into the function pad 32, and a container is manually placed 57 under the faucet 13. The program is then started 58 by entering it into the function pad, and the program blocks 41, 42 and 45–48 in FIG. 1 are utilized until the container is filled.

Figure 5:
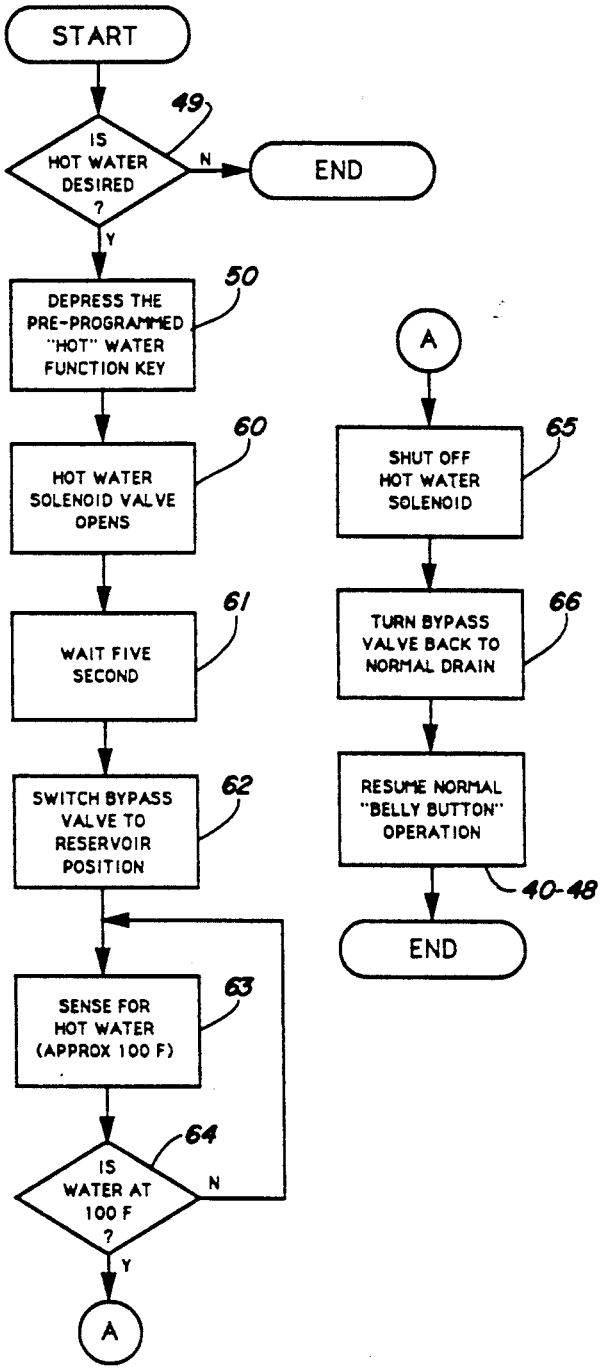

FIG. 5 shows the program designed to divert cold water into the water reservoir 17 when hot water is desired, but cold water is still running since the water has not yet come up to the desired temperature. If hot water is desired 49, the hot water function 50 is entered into the function pad 3 and the hot water solenoid 23 is opened 60. After a five second delay 61 to flush sediment from the system, bypass valve 20 is opened 62 to divert cold water to the water reservoir 17. The hot water sensor 27 continually monitors the hot water temperature 63 and continues looping 64–63 until the temperature reaches say, 100 F. The program then continues from program block 43 in FIG. 2 to the end.

The hot water solenoid 23 is then turned off 65, and the bypass valve 20 is closed 66 (a beeper may sound), thereby diverting water from the water reservoir 17 to the normal 4 drain function, and the program 40–48 described in FIG. 2 is resumed until completion.

The apparatus of this invention provides good water saving capability, particularly if hot water is required. In that instance, cold water in the pipe system which has not yet heated up to the desired temperature, and which otherwise would be lost to drainage, is saved by diverting it to storage in the reservoir 17. Since the reservoir 17 is removable, it can be used as a source of water for plants, and other purposes. Also, the programmed volume control and the on-off control switch 30 minimizes the possibility of overfilling a sink and enables a more controlled use of water.

We claim:

1. A system for controlling flow of hot and cold water, comprising:

a water faucets for supplying hot and cold water, respectively;

b inlet hot and cold water lines connected to the water faucets for supplying hot and cold water to the corresponding hot and cold water faucets;

c sink means for collecting outlet water from the water faucets, the sink means being disposed underneath and adjacent to the water faucets, and the inlet water lines being disposed under the sink means;

d a first drain line connected to, and downwardly from the sink means for draining water in the sink to sewage;

e a second drain line connected to, and downwardly from the sink means for draining water therefrom, the first and second drain lines forming a connection therebetween;

f a water reservoir for receiving water from the second drain line;

g an overflow drain line from the water reservoir and connecting to sewage;

h a by-pass valve mounted between the first and second drain lines in the connection therebetween and adapted to divert water from the first drain line to the second drain line, thereby draining to the water reservoir;

i a temperature sensor mounted within the inlet hot water line;

j a water volume meter mounted within the inlet cold water line and adapted to control the flow rate of the cold water;

k on-off solenoid valves mounted within the inlet hot and cold water lines;

l a microprocessor, including a programming and command keyboard input, and an electrically actuated control box connected thereto for controlling operation of the by-pass valve, water flow rates, water temperature, and the on-off solenoid valves which control hot and cold water flow, the control box being electrically connected to the microprocessor, by-pass valve, on-off solenoid valves, temperature sensor and water volume meter;

m an on-off control switch connected to the microprocessor and positioned in close proximity to the sink, the control switch being adapted to turn on the microprocessor and control box, and thereby turn on the system when depressed by a user's body when the user is in close proximity to the sink, and to turn off the system when pressure of the user's body is removed from the vicinity of the sink and away from contact with the control switch; and, n solenoid actuatable inlet valves mounted within the respective inlet hot and cold water lines for turning hot and cold water on and off.

2. The system of claim 1, in which the water overflow reservoir is portable.

3. The system of claim 1, in which the by-pass valve is actuatable to divert water below a set temperature from the sink into the second drain line thereby draining water into the reservoir until the water temperature reaches a desired level, actuation of the by-pass valve, on-off solenoid switches, and hot water sensor being controlled by the microprocessor and control box to accomplish the diversion of the water.

* * * * *